US009530169B2

(12) United States Patent
Strelec et al.

(10) Patent No.: US 9,530,169 B2
(45) Date of Patent: Dec. 27, 2016

(54) DEMAND RESPONSE AUTOMATED LOAD CHARACTERIZATION SYSTEMS AND METHODS

(71) Applicant: Honeywell International Inc., Morristown, NJ (US)

(72) Inventors: Martin Strelec, Chodov (CZ); Radek Fisera, Mnichovice (CZ)

(73) Assignee: Honeywell International Inc., Morris Plains, NJ (US)

( * ) Notice: Subject to any disclaimer, the term of this patent is extended or adjusted under 35 U.S.C. 154(b) by 538 days.

(21) Appl. No.: 13/945,506

(22) Filed: Jul. 18, 2013

(65) Prior Publication Data

US 2015/0025698 A1 Jan. 22, 2015

(51) Int. Cl.
*G06Q 50/06* (2012.01)

(52) U.S. Cl.
CPC ..... *G06Q 50/06* (2013.01)

(58) Field of Classification Search
CPC ..... G06Q 50/06; Y04S 20/222
USPC ..... 700/286, 291, 295; 705/412
See application file for complete search history.

(56) References Cited

U.S. PATENT DOCUMENTS 8,219,258 B1 * 7/2012 Almeida ..... H02J 3/14 307/34
8,626,319 B2 * 1/2014 Weatherhead ..... G06Q 50/06 700/22
8,731,724 B2 * 5/2014 Drees ..... G05B 15/02 700/276
8,756,024 B2 * 6/2014 Hedley ..... G06Q 30/02 702/130
8,798,802 B2 * 8/2014 Almeida ..... H02J 3/14 307/34
8,903,757 B2 * 12/2014 Desikachari ..... G06F 11/3433 706/59
2010/0153330 A1 * 6/2010 Desikachari ..... G06F 11/3433 706/59
2011/0246381 A1 * 10/2011 Fitch ..... G06Q 10/04 705/313
2012/0022700 A1 * 1/2012 Drees ..... G05B 15/02 700/276
2012/0078431 A1 * 3/2012 Weatherhead ..... G06Q 50/06 700/295
2012/0197456 A1 * 8/2012 Walter ..... G06Q 50/06 700/297
2012/0277925 A1 * 11/2012 Almeida ..... H02J 3/14 700/291
2014/0074305 A1 * 3/2014 Dzafic ..... H02J 13/0013 700/291

* cited by examiner

*Primary Examiner* — Charles Kasenge
(74) *Attorney, Agent, or Firm* — Brooks, Cameron & Huebsch, PLLC

(57) ABSTRACT

Demand response automated load characterization systems and methods are described herein. One method includes identifying a plurality of load models that include a variable that influences an energy demand, normalizing the plurality of load models, aggregating the normalized plurality of load models to generate an aggregated model for the variable.

19 Claims, 5 Drawing Sheets

DEMAND RESPONSE AUTOMATED LOAD CHARACTERIZATION SYSTEMS AND METHODS

TECHNICAL FIELD

The present disclosure relates to demand response automated load characterization systems and methods.

BACKGROUND

Energy providers (e.g., energy companies, electricity providers etc.) can participate on wholesale energy markets where they can buy electricity or offer/sell demand response potential (power to reduce). Energy providers can implement a mechanism to utilize demand side resources. Demand side resources can include reducing or increasing an electric demand of equipment (e.g., building equipment, industrial equipment, facility equipment, etc.) that is connected to a grid. For example, an energy provider can utilize demand side resources for curing short-term (e.g., hours, days, weeks) power imbalances on the grid.

DETAILED DESCRIPTION

Demand response automated load characterization systems and methods are described herein. For example, one or more embodiments can include identifying a plurality of load models that include a variable that influences an energy demand, normalizing the plurality of load models, and aggregating the categorized and/or normalized plurality of load models to generate an aggregated model for the variable.

Demand response automated load characterization can include identifying a plurality of load models. The plurality of models can have a particular model structure (e.g., state space representation) where unknown properties (e.g., parameters) can be identified. The plurality of load models can include various load dynamics over a period of time. Load models can be utilized by a utility company (e.g., electricity provider, etc.) to predict an electrical demand of demand resources (e.g., electrical devices that can be altered to lower or increase electrical demand). Demand resources can be utilized by the utility company for a relatively short term to balance an electrical grid. The demand resources can be manipulated by the utility company to alter the electrical demand of the demand resources.

The plurality of load models can include a particular amount of details relating to the load dynamics (e.g., load dynamic features, etc.) and can include a relatively large quantity of data. The plurality of load models can be difficult to utilize when the quantity of data and/or the quantity of load models is relatively large. It can be beneficial to categorize the plurality of load models can produce a number of aggregated load models that represent a specific level of detail that can be utilized by the utility company.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

As used herein, "a" or "a number of" something can refer to one or more such things. For example, "a number of devices" can refer to one or more devices.

Figure 1:
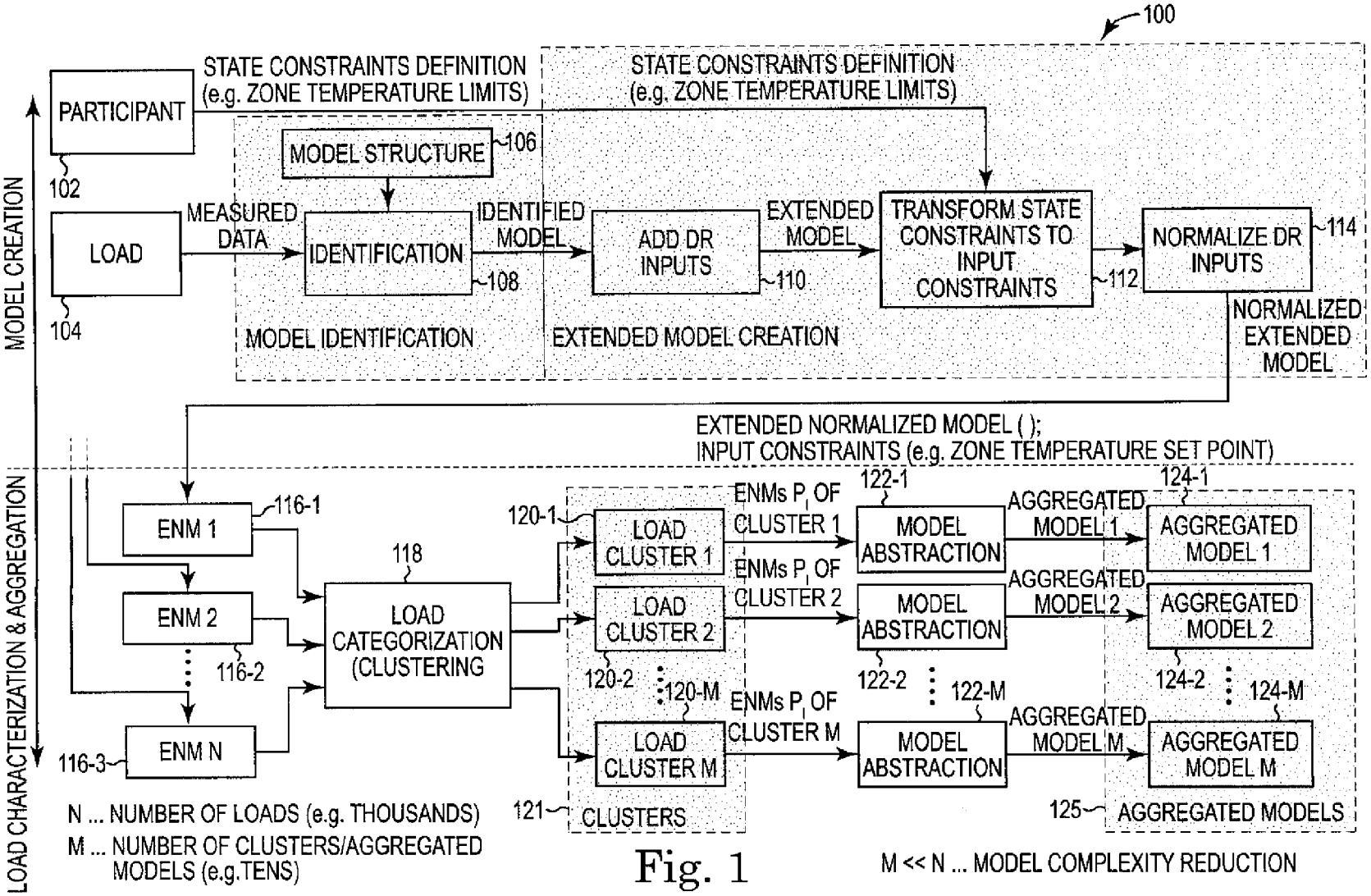
FIG. 1 illustrates an example of a demand response automated load characterization module in accordance with one or more embodiments of the present disclosure.

FIG. 1 illustrates an example of a demand response automated load characterization module 100 in accordance with one or more embodiments of the present disclosure. The demand response automated load characterization module 100 can utilize a measured load 104 (e.g., load measurement, power measurement, etc.) and/or received state constraint definitions from a participant 102 to generate a plurality of aggregate models 125.

The measured load 104 can be a monitored and/or measured by instrumentation (e.g., sensors, etc.) to obtain data relating to the measured load 104 (e.g., current load, currently loaded power, etc.). The data obtained from the measured load 104 can be a quantity of electricity for a number of electrical devices that include a number of state constraints to produce a particular range of states (e.g., room temperature range based on user experience and/or user preferences, etc.). For example, the quantity of electricity can include a quantity of kilowatts of electricity being utilized by the number of electrical devices (e.g., thermostats controlling room temperature) within the number of state constraints (e.g., room temperature limits). In another example, the quantity of electricity can include a percentage of electricity utilized by a demand response electrical device (e.g., electrical device utilized by a utility company as a demand response resource).

The data obtained from the measured load 104 can go through an identification process 108. The identification process 108 can identify a number of model properties 106 within a model that includes a number of load dynamic features of the measured load 104. The load dynamic features (e.g., load parameters, dynamic aspects of the load data, model of the load, etc.) of the measured load 104 can include load fluctuations, quantity of electricity utilized at particular times, state constraints, and/or a quantity of electricity utilized by a demand response electrical device over a period of time.

A number of demand response inputs 110 can be added to the identified model. The number of demand response inputs 110 can be settings of the demand response electrical devices that correspond to the number of load dynamic features of the data. For example, the number of demand response inputs 110 can be settings of the demand response electrical devices that can be changed to lower an electric demand and/or the quantity of electricity utilized by the demand response electrical devices.

The demand response inputs 110 can be utilized to transform the dynamic aspects of the data and/or state constraints to input constraints at 112. State constraints can be constraints set by a participant 102 and/or a user of the demand response electrical devices. For example, state constraints can be temperature settings (e.g., temperature range, etc.) for a heating, ventilation, and air conditioning (HVAC) system. In this example, the state constraints can be 70° F. to 75° F. The input constraints can be settings of the demand response electrical devices to derive the state constraints set by the participant 102. For example, the input constraints can be settings to provide a particular percentage of electrical energy to an HVAC system to produce a particular state within the state constraints.

When the state constraints are converted to input constraint models the input constraint models can be normalized at 114. Normalizing the input constraint models can convert each of the input constraint models to a particular model structure where the input variables have a unified range. For example, each of the input constraint models can be normalized by converting the input constraint models to an extended normalized model (ENM).

Normalizing the input constraint models to an extended normalized model can include performing a standardized method on each of the input constraint models. For example, a unified (e.g., single) mathematical apparatus can be performed on each of the input constraint models to generate the extended normalized models 116-1, 116-2, . . . , 116-N. The unified mathematical apparatus can convert the data within the input constraint models to an extended normalized model with a predetermined level of detail.

The extended normalized models 116-1, 116-2, . . . , 116-N can each be a model of a measured load 104 and/or information received by a participant 102 that is represented by the same model. For example, the information received by the participant 102 can include a number of participant settings and/or a number of participant preferences that are selected by the participant 102. In addition, the extended normalized models 116-1, 116-2, . . . , 116-N can be represented by the same value range for a given period of time. For example, the extended normalized models 116-1, 116-2, . . . , 116-N can be represented between the same value range between a value of 0 to 1 over the same time period. In this example, the values can represent the individual dynamics of each measured load 104 and/or user selected state constraints that have been converted to input constraints.

The extended normalized models 116-1, 116-2, . . . , 116-N can be categorized at 118. Load categorization and/or clustering 118 can create a number of load clusters 121 (e.g., Load cluster 1 120-1, Load cluster 2 12-2, Load cluster M 120-M, etc.) based on a number of properties (e.g., power properties, dynamics, etc.) of the extended normalized models 116-1, 116-2, . . . , 116-N. For example, the extended normalized models 116-1, 116-2, . . . , 116-N can be separated into a number of clusters where each cluster includes extended normalized models that include similar model properties (e.g., similar model structure, similar model dynamics, similar uncertainty level, etc.). The model properties can represent a number of power properties of the measured load 104.

The number of load clusters 121 can each be abstracted to produce a particular aggregated model (e.g., aggregated model 124-1, aggregated model 124-2, . . . , aggregated model 124-M, etc.). The model abstraction (e.g., 122-1, 122-2, . . . , 122-M, etc.) can be utilized for each of the number of load clusters 121. For example, load cluster 120-1 can be abstracted through model abstraction 122-1 to produce an aggregated model 124-1.

Model abstraction can be utilized to reduce the complexity of each load cluster. For example, there can be a plurality of extended normalized models within each load cluster. In this example, the plurality of extended normalized models can be abstracted to a single aggregated representation of the plurality of extended normalized models. That is, a plurality of extended normalized models can be utilized to produce an aggregated model that is based on a number of properties of the extended normalized models within a particular cluster.

The number of aggregated models 125 can be utilized by a utility company to predict demand response capabilities for the number of demand response electrical devices at a particular time based on current conditions. For example, the aggregated models 125 can correspond to a power output of a control strategy and when a corresponding load data (e.g., current load, currently loaded power, etc.) is received and compared to the number of aggregated models 125 a power output can be selected.

Figure 2:
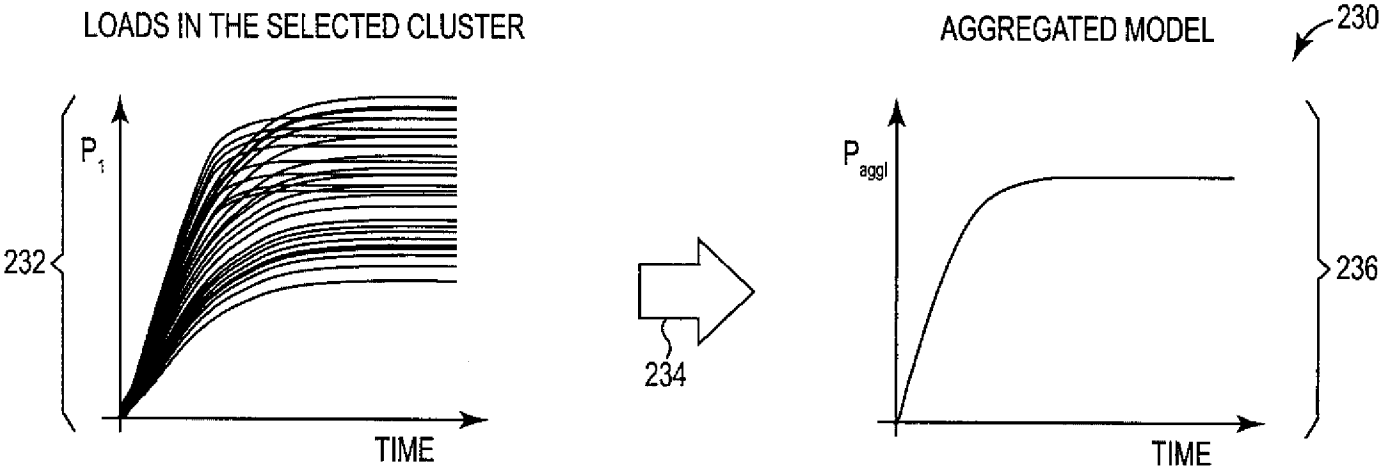
FIG. 2 illustrates an example of load abstraction in accordance with one or more embodiments of the present disclosure.

FIG. 2 illustrates an example of load abstraction 230 in accordance with one or more embodiments of the present disclosure. Load abstraction can be utilized to simplify a plurality of loads within a particular load cluster (e.g., load clusters 121 referenced in FIG. 1, etc.). The particular load cluster can include a plurality of extended normalized models (e.g., extended normalized models 116-1, 116-2, . . . , 116-N as referenced in FIG. 1). The plurality of extended normalized models can be represented in model 232. The plurality of extended normalized models can be represented in the same model 232 when the demand response input model is normalized to include the same properties (e.g., same dynamics, same model structure, same state values, same model, etc.).

The plurality of extended normalized models can be abstracted at 234 to produce an aggregated model 236. Abstracting at 234 can include utilizing the plurality of extended normalized models to produce a single aggregated model 236 that represents properties of the plurality of extended normalized models. For example, the aggregated model 236 can represent a number of power properties of the plurality of extended normalized models within a particular cluster. The particular cluster utilized in abstracting at 234 can include a plurality of extended normalized models that each includes a similar behavior to simplify the abstraction at 234.

The aggregated model 236 can be utilized to predict a desired demand profile upon receiving a particular load and/or demand response control signal. The aggregated model 236 can be utilized to characterize a load behavior of demand resource electrical devices. For example, the aggregated model 236 can be utilized to predict the load behavior for a plurality of HVAC systems that are being utilized as demand resource electrical devices within an electrical grid.

Figure 3:
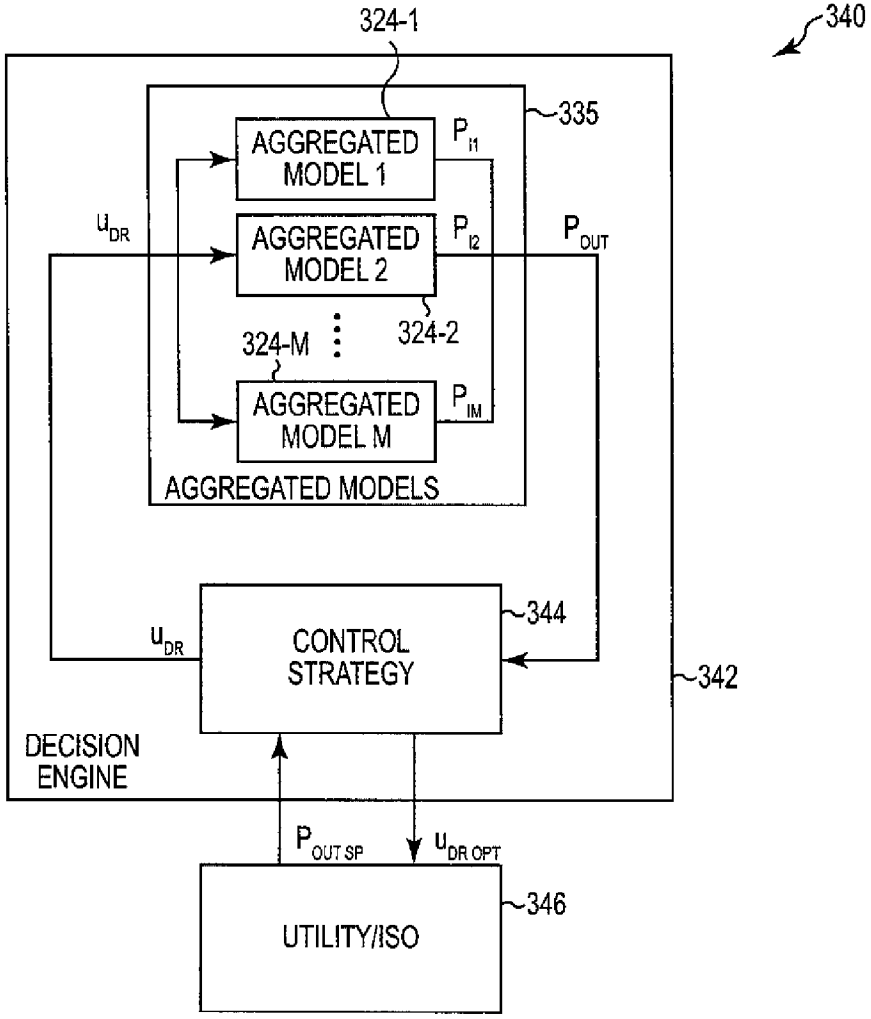
FIG. 3 illustrates an example demand response automated load characterization system in accordance with one or more embodiments of the present disclosure.

FIG. 3 illustrates an example demand response automated load characterization system 340 in accordance with one or more embodiments of the present disclosure. The system 340 can include computer readable instructions to utilize a number of aggregated models 335 to characterize load behavior for a number of demand response electrical devices.

The system 340 can include a utility 346 (e.g., utility company). The utility 346 can include an independent system operator (ISO), a transmission system operator (TSO), and/or a regional transmission organization (RTO) to manage a particular region's electricity grid. The utility 346 can utilize a decision engine 342 to provide a demand response characterization. The demand response characterization can be an optimized demand response characterization for a particular demand profile. For example, the demand response characterization can be utilized by the utility 346 to determine an optimal demand response control signal at various scenarios (e.g., fluctuations within an electrical grid, etc.).

The decision engine 342 can be a computing device (e.g., computing device 560 as referenced in FIG. 5, etc.) that can utilize a combination of software, hardware, and/or logic to provide a demand response characterization for a number of demand response electrical devices.

The decision engine 342 can include a control strategy 344. The control strategy 344 can be a designated strategy for implementing demand response electrical devices for the utility 346 at various demand response profiles (e.g., reference signal, etc.). For example, the control strategy 344 can receive a particular demand response profile from the utility 346 and utilize the aggregated models 335 to provide the demand response characterization to the utility 346. The utility 346 can determine, based at least in part on the demand response characterization, a load reduction potential for a plurality of demand response electrical devices for a particular demand response profile.

The aggregated models 335 can include individual aggregated models 324-1, 324-2, . . . , 324-N for each of a number of load clusters. As described herein, the individual aggregated models 324-1, 324-2, . . . , 324-N can be produced through a process of: model identification, adding demand response signals to the model, state constraint transformation, normalizing demand response inputs, categorization, and abstraction of a measured load and/or state constraints of demand response electrical devices from a participant.

The aggregated models 335 can be utilized to produce an estimate of power demand based on a comparison between the received demand response control signal and the aggregated models 335. The power demand estimate can be different for each aggregated model. That is, a particular demand response signal can have a corresponding power demand estimate for each aggregated model.

The aggregated models 335 can be utilized to determine an expected demand for the particular demand response signal and the expected demand can be sent to the control strategy 344. The control strategy 344 can utilize the received demand profile from the aggregated models 335 to determine the demand response control signal to return to the utility 346. For example, the control strategy can compare the received expected demand from the aggregated models 335 to a current control strategy to determine the demand response control signal.

The utility 346 can utilize the received demand response control signal when utilizing demand response electrical devices for load balancing within an electrical grid. For example, the utility 346 can determine a quantity of electrical power that can be reduced from the demand response electrical devices for providing short term electrical resources that can be used for balancing an electrical grid.

Figure 4:
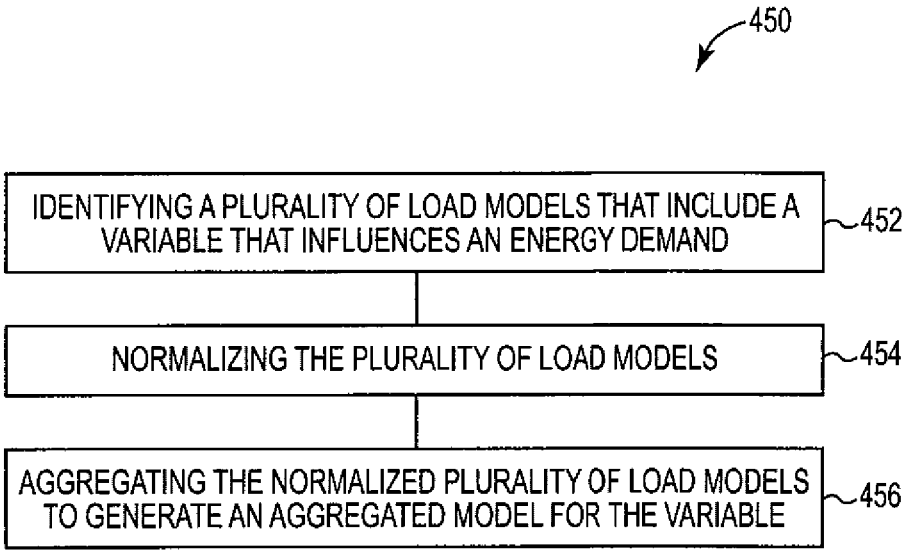
FIG. 4 illustrates an example method for demand response automated load characterization in accordance with one or more embodiments of the present disclosure.

FIG. 4 illustrates an example method 450 for demand response automated load characterization in accordance with one or more embodiments of the present disclosure. The method 450 can be utilized to produce aggregated models that can be utilized to determine an expected demand for a particular demand response signal.

At box 452, the method 450 can include identifying a plurality of load models that include a variable that influences an energy demand. Identifying the plurality of load models can include receiving a load (e.g., load measurements) and comparing the load to a number of model structures to identify a model structure that represents the load. Identifying the plurality of load models can also include receiving a number of state constraints from a participant. As described herein, the plurality of load models can be identified and converted from state constraints to input constraints.

At box 454, the method 450 can include normalizing the plurality of load models. Normalizing the plurality of load models can include converting the plurality of load models to include the same variable restrictions and/or same variable ranges. For example, normalizing the plurality of load models can include converting the plurality of load models to a model with specific ranges (e.g., 0-1, 0-10, etc.) over a period of time. Normalizing the plurality of load models can enable the use of a unified mathematical apparatus to be used on all of the plurality of load models.

At box 456, the method 450 can include aggregating the normalized plurality of load models to generate an aggregated model for the variable. Aggregating the normalized plurality of load models can include the model abstraction of a particular cluster that emerges by categorization of normalized extended models. As described herein, model abstraction can be performed on each of a number of load clusters that were produced through categorization of the normalized plurality of load models.

Figure 5:
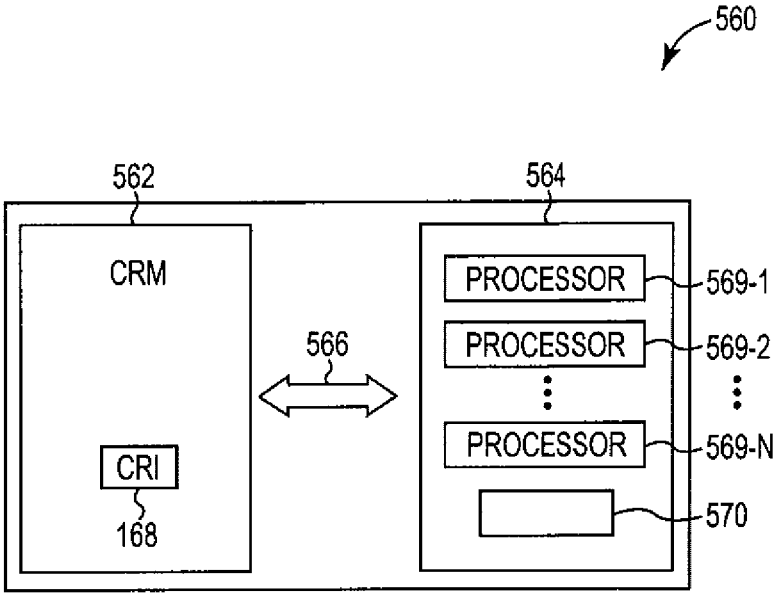
FIG. 5 illustrates a block diagram of an example of a computing device in accordance with one or more embodiments of the present disclosure.

FIG. 5 illustrates a block diagram of an example of a computing device 560 in accordance with one or more embodiments of the present disclosure. The computing device 560 can include a communication interface (e.g., wireless network interface controller, IEEE 802.11 adapters, etc.) for receiving wireless data. The communication interface can be integrated in the computing device 560 and/or be an external card.

The computing device 560, as described herein, can also include a computer readable medium (CRM) 562 in communication with processing resources 569-1, 569-2 . . . , 569-N. CRM 562 can be in communication with a device 564 (e.g., a Java® application server, among others) having processor resources 569-1, 569-2, . . . , 569-N. The device 564 can be in communication with a tangible non-transitory CRM 562 storing a set of computer-readable instructions (CRI) 568 (e.g., modules) executable by one or more of the processor resources 569-1, 569-2, . . . , 569-N, as described herein. The CRI 568 can also be stored in remote memory managed by a server and represent an installation package that can be downloaded, installed, and executed. The device 564 can include memory resources 570, and the processor resources 569-1, 569-2, . . . , 569-N can be coupled to the memory resources 570.

Processor resources 569-1, 569-2, . . . , 569-N can execute CRI 568 that can be stored on an internal or external non-transitory CRM 562. The processor resources 569-1, 569-2, . . . , 569-N can execute CRI 568 to perform various functions. For example, the processor resources 569-1, 569-2, . . . , 569-N can execute CRI 568 to perform a number of functions (e.g., identifying a plurality of load models that include a variable that influences an energy demand, etc.). A non-transitory CRM (e.g., CRM 562), as used herein, can include volatile and/or non-volatile memory. Volatile memory can include memory that depends upon power to store information, such as various types of dynamic random access memory (DRAM), among others. Non-volatile memory can include memory that does not depend upon power to store information. Examples of non-volatile memory can include solid state media such as flash memory, electrically erasable programmable read-only memory (EEPROM), phase change random access memory (PCRAM), magnetic memory such as a hard disk, tape drives, floppy disk, and/or tape memory, optical discs, digital versatile discs (DVD), Blu-ray discs (BD), compact discs (CD), and/or a solid state drive (SSD), as well as other types of computer-readable media.

The non-transitory CRM 562 can also include distributed storage media. For example, the CRM 562 can be distributed among various locations.

The non-transitory CRM 562 can be integral, or communicatively coupled, to a computing device, in a wired and/or a wireless manner. For example, the non-transitory CRM 562 can be an internal memory, a portable memory, a portable disk, or a memory associated with another computing resource (e.g., enabling CRIs to be transferred and/or executed across a network such as the Internet).

The CRM 562 can be in communication with the processor resources 569-1, 569-2, . . . , 569-N via a communication path 566. The communication path 566 can be local or remote to a machine (e.g., a computer) associated with the processor resources 569-1, 569-2, . . . , 569-N. Examples of a local communication path 566 can include an electrical bus internal to a machine (e.g., a computer) where the CRM 562 is one of volatile, non-volatile, fixed, and/or removable storage medium in communication with the processor resources 569-1, 569-2, . . . , 569-N via the electrical bus. Examples of such electrical buses can include Industry Standard Architecture (ISA), Peripheral Component Interconnect (PCI), Advanced Technology Attachment (ATA), Small Computer System Interface (SCSI), Universal Serial Bus (USB), among other types of electrical buses and variants thereof.

The communication path 566 can be such that the CRM 562 is remote from the processor resources e.g., 569-1, 569-2, . . . , 569-N, such as in a network relationship between the CRM 562 and the processor resources (e.g., 569-1, 569-2, . . . , 569-N). That is, the communication path 566 can be a network relationship. Examples of such a network relationship can include a local area network (LAN), wide area network (WAN), personal area network (PAN), and the Internet, among others. In such examples, the CRM 562 can be associated with a first computing device and the processor resources 569-1, 569-2, . . . , 569-N can be associated with a second computing device (e.g., a Java® server).

As described herein, a "module" can include computer readable instructions (e.g., CRI 568) that can be executed by a processor to perform a particular function. A module can also include hardware, firmware, and/or logic that can perform a particular function.

As used herein, "logic" is an alternative or additional processing resource to execute the actions and/or functions, described herein, which includes hardware (e.g., various forms of transistor logic, application specific integrated circuits (ASICs)), as opposed to computer executable instructions (e.g., software, firmware) stored in memory and executable by a processor.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A computer implemented method for demand response automated load characterization, comprising:

identifying a plurality of load models that includes a variable that influences an energy demand of a demand response electrical device, wherein the variable includes a selected state setting for an area and wherein the demand response electrical device is a demand response resource to alter electrical demand within an electrical grid;

altering the variable of the plurality of load models to a demand response input for the demand response electrical device, wherein the demand response input includes a setting of the demand response electrical device;

normalizing the identified plurality of load models that includes the demand response input;

aggregating the normalized plurality of load models to generate an aggregated model for the demand response input; and altering the demand response input for the demand response electrical device to cure a predicted power imbalance of the electrical grid based on the aggregated plurality of load models.

2. The method of claim 1, comprising transforming the plurality of load models from a first constraint to an input constraint.

3. The method of claim 2, wherein the first constraint is a state constraint determined by a user.

4. The method of claim 1, comprising categorizing the plurality of load models based on model properties of the plurality of load models.

5. The method of claim 4, wherein categorizing the plurality of load models includes utilizing a number of load dynamic features of the plurality of load models.

6. The method of claim 1, wherein normalizing the plurality of load models includes utilizing a standardized method for normalizing the plurality of load models.

7. The method of claim 1, comprising implementing the aggregated model with a control strategy of a utility company.

8. A non-transitory computer readable medium, comprising computer readable instructions stored thereon that are executable by a processor to:

identify a plurality of load models that each includes a variable that influences an energy demand of a demand response electrical device, wherein the variable includes a selected state setting for an area and wherein the demand response electrical device is a demand response resource to alter electrical demand within an electrical grid;

alter the variable of the plurality of load models to a demand response input for the demand response electrical device, wherein the demand response input includes a setting of the demand response electrical device;

normalize each of the plurality of load models that includes the demand response input;

categorize each of the plurality of normalized load models based on the demand response inputs;

aggregate each of the normalized plurality of load models to generate an aggregated model for each category; and alter the demand response input for the demand response electrical device to cure a predicted power imbalance of the electrical grid based on the aggregated plurality of load models.

9. The medium of claim 8, comprising instructions to transform state constraints selected by a number of users to input constraints.

10. The medium of claim 8, wherein the aggregated model is utilized to represent load dynamics of the plurality of load models.

11. The medium of claim 8, wherein the variable includes a particular load dynamic.

12. The medium of claim 8, wherein the plurality of load models are based in part on historical data.

13. The medium of claim 8, wherein the plurality of load models are normalized utilizing a unified mathematical apparatus.

14. The medium of claim 8, wherein the plurality of load models are categorized based on load reduction potential and load dynamics.

15. A computing device for demand response automated load characterization, comprising:

a memory; and a processor configured to execute executable instructions stored in the memory to:

identify a plurality of load models that includes a number of state variables that influence an energy demand of a demand response electrical device, wherein the number of state variables include a selected state setting for an area and wherein the demand response electrical device is a demand response resource to alter electrical demand within an electrical grid;

alter the number of state variables to demand response inputs for the demand response electrical device, wherein the demand respond inputs include settings of the demand response electrical device;

normalize each of the plurality of load models that includes the demand response inputs;

categorize each of the normalized plurality of load models based on the demand response inputs;

aggregate each of the normalized plurality of load models to generate an aggregated model for each category; and alter the demand response inputs for the demand response electrical device to cure a predicted power imbalance of the electrical grid based on the aggregated model for each category.

16. The system of claim 15, wherein instructions to normalize each of the plurality of load models include instructions to normalize each of the plurality of load models within the same range of values.

17. The system of claim 15, wherein the aggregated model includes representations of load behavior from each of the plurality of load models.

18. The system of claim 15, wherein the aggregated model comprises a predetermined level of detail to represent a category of the plurality of load models.

19. The system of claim 15, wherein the aggregated model is utilized to predict an expected behavior of demand resources.

* * * * *